US006325265B1

(12) United States Patent
Münch et al.

(10) Patent No.: US 6,325,265 B1
(45) Date of Patent: Dec. 4, 2001

(54) FEED ACCESSORY APPARATUS AND PROCESS FOR FEEDING THE TAIL OF A MATERIAL WEB INTO A ROLL MACHINE

(75) Inventors: Christian Münch; Reinhard Hoffmann, both of Krefeld (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/633,248

(22) Filed: Aug. 4, 2000

(30) Foreign Application Priority Data

Aug. 6, 1999 (DE) ..... 199 37 196

(51) Int. Cl.[7] ..... G03B 1/56; B65H 16/00

(52) U.S. Cl. ..... 226/91; 226/101; 242/562.1; 400/613.1

(58) Field of Search ..... 226/91, 92, 101; 242/562.1; 400/613.1

(56) References Cited

U.S. PATENT DOCUMENTS 4,763,822 8/1988 Mohrsen .

FOREIGN PATENT DOCUMENTS 1461226 1/1969 (DE) .
3301816 8/1983 (DE) .
0232689 8/1987 (EP) .

*Primary Examiner*—Michael R. Mansen
(74) *Attorney, Agent, or Firm*—Greenblum & Bernstein P.L.C.

(57) ABSTRACT

Feed accessory apparatus and process for feeding the tail of a material web into a roll machine. The apparatus includes an infeed section, a discharge section, a gripper head, and a carrier. The gripper head is pivotably arranged on the carrier to pivot around a swivel axis to be located in at least one of an infeed position and a discharge position. The process includes receiving a threading end of a material web in the apparatus while it is in an infeed position, and pivoting the apparatus around a swivel axis into a discharge position.

25 Claims, 2 Drawing Sheets

FEED ACCESSORY APPARATUS AND PROCESS FOR FEEDING THE TAIL OF A MATERIAL WEB INTO A ROLL MACHINE

CROSS-REFERENCE TO RELATED APPLICATIONS

The present application claims priority under 35 U.S.C. §119 of German Patent Application No. 199 37 196.2, filed on Aug. 6, 1999, the disclosure of which is expressly incorporated by reference herein in its entirety.

BACKGROUND OF THE INVENTION

1. Field of the Invention

The invention relates to a feed accessory apparatus for feeding the tail of a material web into a roll machine.

2. Discussion of Background Information

The material web is subjected to increased pressure and, if applicable, also to elevated temperature in the nips. The effects intended to be achieved hereby extend from compression of the material web to improvement of the surface qualities. To this end, it is often necessary for the material web to run through several nips in sequence. The rolls here are generally arranged in what is known as a roll stack, i.e., their axes lie in a common plane.

Before treatment of the material web can be allowed to start, the material web must be threaded into the roll machine, i.e., it must be lead through the first nip, passed it around a guide roll, lead through the next nip, etc. In the case of a paper web, this is often handled in such a way that the tail of the paper web is folded into a point which then has a certain stiffness so it can be passed through the individual nips or roll gaps. Alternatively, a narrow strip can be cut out at the end of the paper web and then guided through the calender. Once the strip has run through the calender, the paper web can be widened again.

Feeding of the paper web can be done automatically, for instance, by guide devices which are known, e.g., from EP 0 232 689 A. The disadvantage of this design, however, is that the resources required and hence the costs for the installation are very high. Moreover, accessibility of the calender during operation is drastically reduced. If tears in the paper web occur, hazardous paper jams occur and sometimes damage is caused to equipment and rolls. It is difficult to see the moving paper web. The assembly costs at roll change are high. It is very costly to swing out the complete web guide system after feeding of the web and, in most cases, this cannot be done for space reasons.

Consequently, in many situations, the paper web is still threaded in by hand even today. During the process, the calender is set to operate slowly, and the paper web is then passed from nip to nip. This is a very labor-intensive procedure, and thus time consuming. What is extremely important is that a relatively high risk of injury exists in this context. The individual operator must reach relatively far into the calender to be able to slip the paper web into the nip. Even when the rolls are running slowly, there is still the risk that the operator's hand will be pulled along into the open nip. Contusions and other injuries frequently occur in this context.

SUMMARY OF THE INVENTION

The present invention simplifies threading of a material web into a roll machine.

In the present invention, a feed accessory apparatus for feeding the tail of a material web into a roll machine is specified with a gripper head and a carrier. The gripper head has an infeed section and a discharge section and is arranged on the carrier such that it can pivot about a swivel axis between an infeed and a discharge position.

Using this apparatus, it is now possible to grasp the material web when it has passed through the nip. The infeed section is used for this purpose. Once the tail of the material web has been gripped with the aid of the apparatus, it can be held firmly, and the tail of the material web can be pulled forward to the next desired nip, where the gripper head is pivoted and the material web is let out again, i.e., such that it is slipped through the next desired nip. This results in a marked reduction in the risk of injury because it is no longer necessary for the operator's hand to enter the vicinity of the nip, i.e., the feed accessory apparatus goes there instead. So that the gripper head can fulfill both functions, i.e., gripping and pulling, as well as sliding into the nip, it pivots between two positions. As a result, it is not necessary for the gripper head to wrap around during any stage of the process.

It is advantageous for the swivel axis to be substantially perpendicular to the feed direction of the material web. If one looks at a sectional view of a roll machine in which the roll axes are substantially perpendicular to the plane of the section, the swivel axis is also substantially perpendicular to this plane. In this manner, the material web can be grasped and then, with the aid of the gripper head, can be directed parallel to the rotational axes of the rolls. Then the tail of the material web is automatically in the correct position in front of the next nip. Only a displacement parallel to the roll plane may still be necessary. Then the feed direction is "right" again.

Preferably the gripper head has a holding mechanism. With it, the material web is held reliably and in a defined position in the gripper head. This further simplifies handling of the material web tail.

In an especially preferred embodiment, a discharge section can include an accessory drive apparatus. Using the accessory drive apparatus, the tail of the material web can be pushed into the nip of the roll machine. This saves time because the material web can be propelled, specifically at the discharge, so that the length of free web that has to accommodate the thrust can be kept as short as possible. Thus, a small saving of material results in addition to the saving of time.

More advantageously, a material web travel path has an end section that runs below the accessory drive apparatus in the infeed position and runs above it in the discharge position. The material web travel path is the path that the material web follows when it passes through the threading accessory device. When the material web enters the infeed section, it will follow gravity and attempt to exit the device from the bottom. Since the end section of the material web travel path is located below the accessory drive apparatus, the material web is not hindered by the accessory drive apparatus during infeed. In contrast, when the gripper head is pivoted and is located in the discharge position, the accessory drive apparatus is located below the end sections, so the material web tail then rests upon the accessory drive apparatus. This ensures that the accessory drive apparatus can act upon the tail of the material web in the discharge position.

It is advantageous for the accessory drive apparatus to have at least one rotatably mounted roller that lies beneath the material web in the discharge position. With the aid of the rotatable roller, the material web can then be pressed against the top of the two rolls that form the nip into which the tail of the material web is to be threaded. This roll then drives the material web, while the roller ensures that the drive force which is frictionally transmitted from the roll to the material web can be essentially fully utilized to advance the material web. The tail of the material web then either proceeds directly into the nip or strikes the lower of the two rolls forming the nip, and is then pushed into the nip by this roll.

It is especially preferred in this context for an auxiliary roller that is in driving contact with the roller to be arranged beneath the roller in the discharge position. The discharge section of the gripper head can now be positioned in front of the two rolls forming the nip in such a manner that the roller rests against the upper roll with the material web between them, and the auxiliary roller rests against the lower roll. Thus the lower roll drives the auxiliary roller, which drives the roller through the driving contact, which can include, e.g., a simple frictional connection. Accordingly, the material web is driven not only by the upper roll, but also by the interaction of the upper roll with the roller. In this manner, the stress on the material web is kept extraordinarily low. It is also possible here for other transmission elements to be arranged between the auxiliary roller and the roller, e.g., gears, chains, or the like, as long as the rotational direction of the roller matches that of the upper roll.

Preferably, the roller and the auxiliary roller have the same diameter. This makes it possible to ensure that, in a simple manner, the roller has the same circumferential velocity as the roll so that a slip in the material web can be avoided.

Preferably, it is possible for the roller or the auxiliary roller to be able to be brought into driving contact with a roll of the roll machine. This driving contact can be produced, e.g., by the pivoting motion of the gripper head. Thus, the roller and auxiliary roller do not require a separate drive, and hence, do not require a separate motor. Rather, they are driven by the relevant roll of the roll machine. This has the additional advantage that the circumferential velocities of the roll and the relevant roller conform to one another, with the result that the material web can be fed into the nip at the correct speed. Thus, excessive stress on the material web is avoided.

It is advantageous for the infeed section to have a channel with a cross section that is funnel-shaped, at least in sections. It is only necessary for this funnel shape to exist in the plane of the material web feed direction. With this embodiment, it is possible to catch the tail of the material web and to direct it, such that gripping can be easily followed by threading into the next nip.

Preferably, the channel opens downwardly in the infeed position. Once the material web has entered the channel, it is pushed along and can then fall downwardly out of the opening.

It is advantageous for the channel to have a wall that covers the accessory drive apparatus. In this way, there is no risk that the tail of the material web will collide with the accessory drive apparatus during grasping of the material web, i.e., when the material web runs into the infeed section.

Preferably, at least one of the two walls delimiting the channel at the top and bottom has a scraper-like edge. "Top" and "bottom" here designate the directions defined by the roll stack. However, the direction need not necessarily be vertical, e.g., the calender or the roll stack can be horizontal or inclined. With the embodiment as a scraper blade, it is possible to allow the relevant wall to be directly adjacent to the relevant roll. Even if the material web adheres to the roll, it is lifted from the roll by the scraper-like wall and guided into the infeed section.

The holding mechanism preferably has a die that acts in conjunction with a mating surface. As soon as the material web has been fed far enough into the infeed section, the die can be actuated. It then firmly presses the material web against the mating surface in the manner of a clamp. In this context, the die can be actuated in various ways. A hydraulic or air cylinder is conceivable. However, it is also possible to actuate such a die, e.g., via a Bowden cable.

It is preferable for the die to be located above the material web in the infeed position and for the mating surface to be smooth. The tail of the material web can then be advanced on the mating surface without encountering any obstacles. The die then acts on the material web from above so that it holds the material web in place when this is desired but does not otherwise hinder its advance.

The present invention is directed to a feed accessory apparatus for feeding the tail of a material web into a roll machine. The apparatus includes an infeed section, a discharge section, a gripper head, and a carrier. The gripper head is pivotably arranged on the carrier to pivot around a swivel axis to be located in at least one of an infeed position and a discharge position.

In accordance with a feature of the invention, the swivel axis may be substantially perpendicular to a feed direction of the material web.

According to another feature of the present invention, the gripper head can include a holding mechanism.

The discharge section can include an accessory drive apparatus. While in the infeed position, the material web can be guided to travel below the accessory drive apparatus, and, in the discharge position, the material web can be guided to run over the accessory drive apparatus. The accessory drive apparatus may include at least one rotatably mounted roller which lies beneath the material web when in the discharge position. The accessory apparatus may further include an auxiliary roller arranged beneath the at least one rotatably mounted roller when in the discharge position, and the auxiliary roller may be arranged in driving contact with the at least one rotatably mounted roller. Further, the at least one rotatably mounted roller and the auxiliary roller may have a substantially same diameter. One of the at least one rotatably mounted roller and the auxiliary roller can be brought into driving contact with a roll of the roll machine.

In accordance with still another feature of the present invention, the infeed section may include a channel having at least a funnel-shaped cross sectional portion. The channel can open downwardly in the infeed position. The channel may include a wall that covers the accessory drive apparatus. Further, the channel can be delimited by at least two walls arranged as a top and bottom wall, and at least one of the at least two walls can include a scraper-like edge.

According to a further feature of the invention, the gripper head may include a holding mechanism with a die that acts in conjunction with a mating surface. The die can be located above the material web in the infeed position, and the mating surface can be smooth.

The present invention is directed to a process of threading calender with a feed accessory apparatus that includes an infeed section, a discharge section, a gripper head, and a carrier. The process includes receiving a threading end of a material web in the apparatus while it is in an infeed position, and pivoting the apparatus around a swivel axis into a discharge position.

According to a feature of the present invention, in the infeed position, the gripper head can hold the material web during the pivoting.

In accordance with another feature of the instant invention, the threading end can be guided through the apparatus and out of an opening prior to pivoting.

The discharge section may include an accessory drive apparatus having at least one rotatable roll. The at least one rotatable roll can be located above the threading strip in the infeed position and can be located beneath the threading strip in the discharge position. In the discharge position, the process can further include forming a nip between the at least one rotatable roll and an upper roll forming a next nip through which the threading strip is to be guided. The accessory drive apparatus may include an auxiliary roller which is arranged to frictionally drive the at least one rotatable roll. The auxiliary roller may be driven by a lower roll forming the next nip through which the threading strip is to be guided.

According to yet another feature of the invention, the apparatus may further include a wall arranged above the threading strip in the infeed position and below the threading strip in the discharge position. The gripping head can include a contact element, and the process may further include pressing the contact element against the material web to pin the material web against the wall during pivoting.

The present invention is directed to a feed accessory apparatus for feeding the tail of a material web into a roll machine. The apparatus includes an infeed section, a discharge section including an accessory drive apparatus having at least one rotatable roll and an auxiliary roller, a gripper head including a holding mechanism, and a carrier. The gripper head is pivotably arranged on the carrier to pivot around a swivel axis to be located in at least one of an infeed position and a discharge position. In the discharge position, the at least one rotatably mounted roller is positioned beneath the material web and the auxiliary roller is arranged beneath the at least one rotatably mounted roller. One of the at least one rotatably mounted roller and the auxiliary roller can be brought into driving contact with a roll of the roll machine, and the infeed section includes a channel having at least a funnel-shaped cross sectional portion, and the channel opens downwardly in the infeed position. The holding mechanism includes a die that acts in conjunction with a mating surface.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention is described below using a paper web as an example of a material web and using a super calender as an example of a roll machine. However, the invention is not intended to be limited to these specific examples. In particular, other types of material webs, such as cardboard, film, or textile material webs can be utilized, as well as other machines, e.g., a glazing machine or another machine in which several rolls work together in such a way that they form a plurality of nips or roll gaps.

Figure 1:
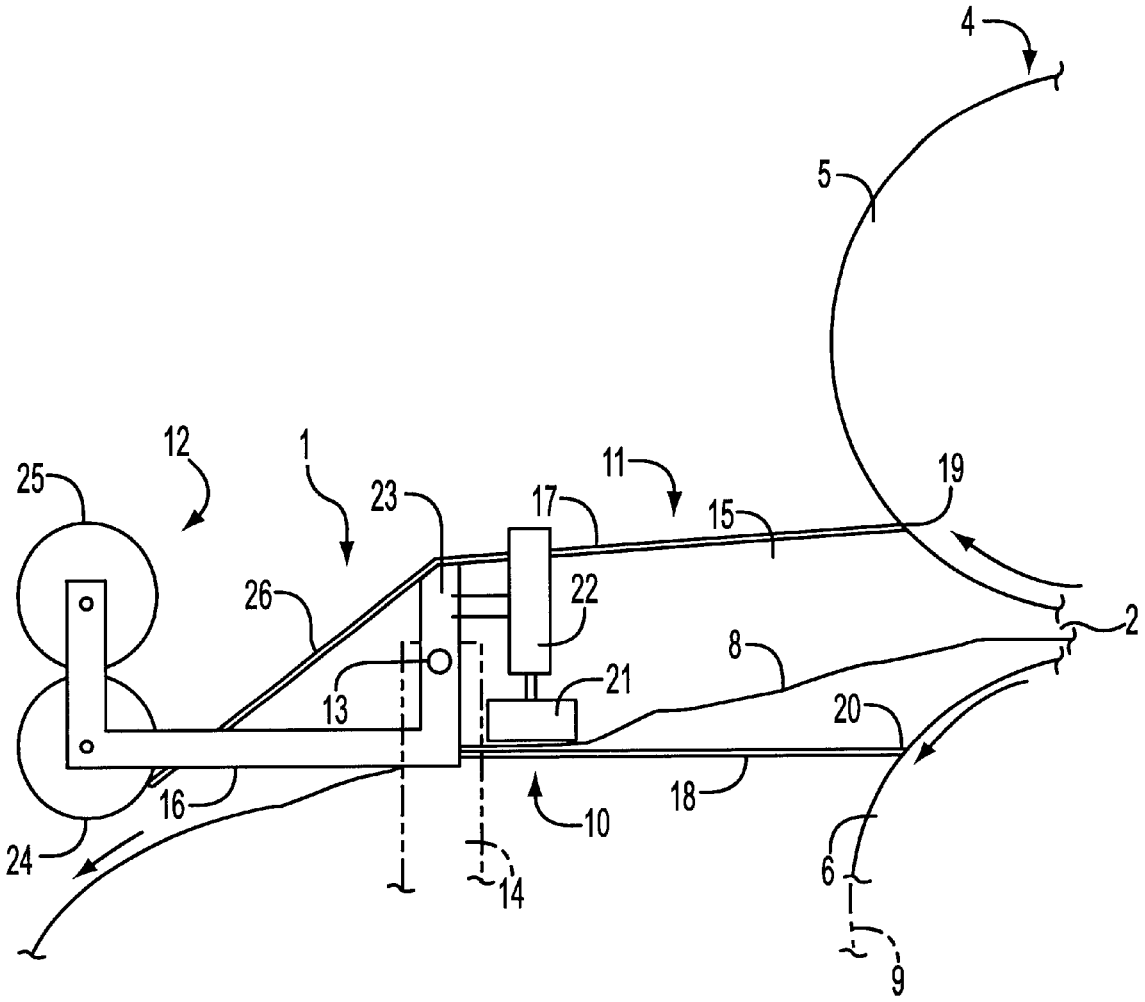
FIG. 1 illustrates a feed accessory apparatus with its gripper head in the infeed position.
Figure 2:
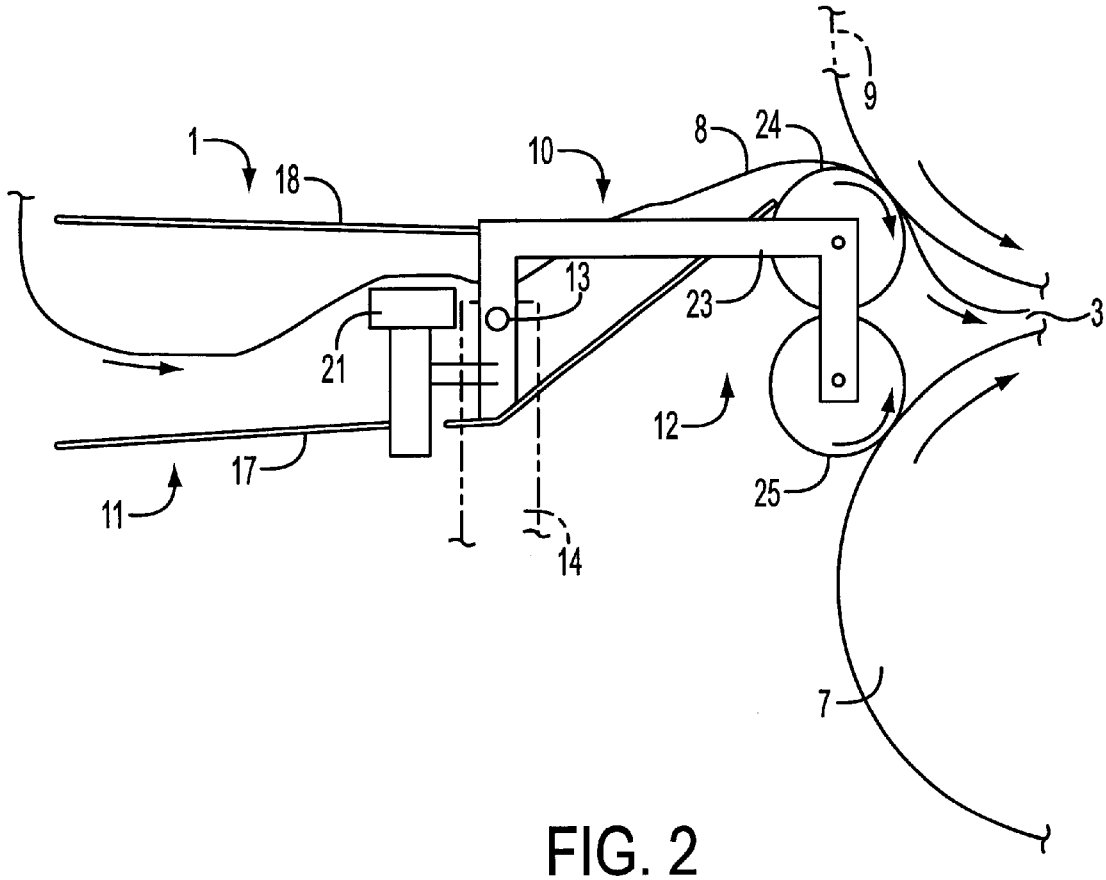
FIG. 2 illustrates the apparatus with the gripper head in the discharge position.

FIGS. 1 and 2 depict a feed accessory apparatus 1 in front of two different nips 2, 3 of a roll stack 4. In the simplest case, roll stack 4 has three rolls 5, 6, and 7. A material web 8, e.g., a paper web, is treated in nips 2 and 3, which is to say subjected to increased pressure and, in many cases, to elevated temperature. In order to show that material web 8 need not necessarily be fed into a nip 3 which immediately follows nip 2, i.e., with only one roll between them, a separation line 9 is schematically indicated in roll 6. Thus, a number of additional rolls, e.g., an odd number of rolls, can also be located between nips 2 and 3.

Apparatus 1 includes a gripper head 10 with an infeed section 11, which is arranged to face nip 2 in FIG. 1, and a discharge section 12, which is arranged to face nip 2 in FIG. 2. In order to be arranged into these different positions, gripper head 10 can be pivoted by approximately 180° about a swivel axis 13. Swivel axis 13 is substantially perpendicular to the plane of the instant drawing, as are the rotational axes of rolls 5, 6, and 7. Gripper head 10 is connected to a carrier 14, which can take a variety of forms. In its simplest case, carrier 14 can be a rod, e.g., a telescoping rod, with which an operator can manually place gripper head 10 in front of appropriate nip 2 or 3. However, it is also possible for carrier 14 include a machine element that travels back and forth on the calender. For example, carrier 14 can be attached to a movable stage (not shown).

Infeed section 11 includes a channel 15 that opens toward nip 2 in a funnel-like manner, and tapers toward carrier 14. On the other side of carrier 14, channel 15 has an opening 16 which points vertically downwardly in the infeed position depicted in FIG. 1. Channel 15 is delimited by two walls 17 and 18 whose ends 19 and 20 resemble scraper blades arranged to face rolls 5 and 6, i.e., they can rest against rolls 5 and 6 and, if necessary, lift material web 8 therefrom.

Otherwise, channel 15 is open on at least one side parallel to the plane of the instant drawing so that gripper head 10 can be moved substantially perpendicular to the plane of the instant drawing to separate from material web 8 after the threading process is finished.

Bottom wall 18 (with reference to the position in FIG. 1) is smooth. When material web 8 enters channel 15, it can slide along bottom wall 18 to opening 16.

Above bottom wall 18 (again with reference to the position in FIG. 1) is located a die 21, which can be lowered to wall 18 by an actuating unit 22 to hold material web 8 there. Holding can be performed as soon as material web 8 penetrates far enough into feed accessory apparatus 1, as is described further below. Here, actuating unit 22 can take the form of a pneumatic or hydraulic cylinder. It can also be an electromagnet. It is also possible for the actuating unit 22 to contain a reversing lever actuated by a Bowden cable (not shown in detail). Actuating unit 22 is mounted to a frame 23 to which walls 17 and 18S are also attached and which carries swivel axis 13.

Also attached to frame 23 are a roller 24 and an auxiliary roller 25, i.e., at an opposite end of apparatus 1 so that rollers 24 and 25 form the end of discharge section 12. Rollers 24 and 25 are in frictional contact with one another, i.e., when one roller turns, the other roller turns with it through frictional action.

Rollers 24 and 25 are covered by a section 26 of wall 17 that runs at an angle and deflects material web 8, i.e., if it strikes there, downwardly toward opening 16.

Once material web 8 is advanced far enough that it arrives under rollers 24 and 25, i.e., it can be caught by roller 24 when gripper head 10 is pivoted about swivel axis 13, die 21 is lowered and material web 8 is clamped between die 21 and wall 18.

Gripper head 10 is then pivoted by approximately 180° about swivel axis 13 and carrier 14 is moved to a next nip 3.

It can be seen from FIG. 2 that material web 8 now lies above roller 24. When gripper head 10 is moved slightly away from roll stack 4 for pivoting (not shown) and then moved back to roll stack 4 (to the right in FIG. 2), auxiliary roller 25 comes into contact with bottom roll 7 delimiting nip 3, and is thereby driven. This drive motion is shared by roller 24 by frictional action. Since roll 6 also rotates, i.e., a same circumferential velocity as roll 7, material web 8 is subjected to a driving force from both sides in nip 3 between roller 24 and roll 6. The tail of material web 8 is then pushed toward nip 3. If the tail does not immediately reach nip 3, but instead initially rests against roll 7, then roll 7 conveys the tail into nip 3. Die 21 has first been raised from now top wall 18 so that material web 8 can be drawn forward though nip 2 between roller 24 and roll 6.

Apparatus 1 operates as follows: the calender is operated at "creep rate," which is to say approximately 10–20 m/min. Material web 8 also emerges from nip 2 at this speed. Gripper head 10 has first been positioned such that channel 15 stands in front of nip 2 so that the tail of material web 8 is captured and slides along bottom wall 18 past rotational axis 13 to opening 16. Once material web 8 has advanced far enough that it is (or can be) caught by roller 24 during a counterclockwise rotation of gripper head 10, the brake is activated, i.e., die 21 is lowered toward wall 18. The entire gripper head 10 moves a short distance away from roll stack 4, rotates by approximately 180°, and assumes the position shown in FIG. 2. Rollers 24 and 25 are pressed against rolls 6 and 7 forming nip 3. Auxiliary roller 25, and consequently roller 24, is driven by bottom roll 7. After die 21 is released, material web strip 8 is threaded into next nip 3 by rotation of roller 24 and top calender roll 6.

Gripper head 10 is now moved out of material web 8 and parallel to the rotational axis of rolls 5, 6, and 7, i.e., substantially perpendicular to the plane of the instant drawing. This is possible because channel 15 is laterally open on at least one side. If material web 8 is only a strip, then the strip can be cut to full width. If a folded point is used, gradual widening of the material web occurs automatically.

Apparatus 1 can be installed on an automated machine as well as used manually on a hand tool. In both cases, the work of the calendering personnel is simplified and, above all, the work is made safer. Moreover, it may be possible to omit finger protectors.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A feed accessory apparatus for feeding the tail of a material web into a roll machine, comprising:

an infeed section;

a discharge section;

a gripper head positioned between said infeed section and said discharge section;

a carrier; and said gripper head, said infeed section, and said discharge section being pivotably arranged on said carrier to pivot around a swivel axis to be located in at least one of an infeed position and a discharge position.

2. The apparatus in accordance with claim 1, wherein the swivel axis is substantially perpendicular to a feed direction of the material web.

3. The apparatus in accordance with claim 1, wherein said gripper head comprises a holding mechanism.

4. The apparatus in accordance with claim 1, wherein said discharge section comprises an accessory drive apparatus.

5. The apparatus in accordance with claim 4, wherein, while in said infeed position, the material web is guided to travel below said accessory drive apparatus, and wherein, in said discharge position, the material web is guided to ran over said accessory drive apparatus.

6. The apparatus in accordance with claim 4, wherein said accessory drive apparatus comprises at least one rotatably mounted roller which lies beneath the material web when in said discharge position.

7. The apparatus in accordance with claim 6, wherein said accessory apparatus further comprises an auxiliary roller arranged beneath said at least one rotatably mounted roller when in said discharge position, and wherein said auxiliary roller is arranged in driving contact with said at least one rotatably mounted roller.

8. The apparatus in accordance with claim 7, wherein one of said at least one rotatably mounted roller and said auxiliary roller can be brought into driving contact with a roll of the roll machine.

9. The apparatus in accordance with claim 6, wherein said at least one rotatably mounted roller and said auxiliary roller have a substantially same diameter.

10. The apparatus in accordance with claim 4, wherein said infeed section comprises a channel having at least a funnel-shaped cross sectional portion.

11. The apparatus in accordance with claim 10, wherein said channel opens downwardly in said infeed position.

12. The apparatus in accordance with claim 10, wherein said channel comprises a wall that covers said accessory drive apparatus.

13. The apparatus in accordance with claim 10, wherein said channel delimited by at least two walls arranged as a top and bottom wall, and wherein at least one of said at least two walls comprise a scraper-like edge.

14. The apparatus in accordance with claim 1, wherein said gripper head comprises a holding mechanism with a die that acts in conjunction with a mating surface.

15. The apparatus in accordance with claim 14, wherein said die is located above the material web in said infeed position, and wherein said mating surface is smooth.

16. A process of threading calender with a feed accessory apparatus that includes an infeed section, a discharge section, a gripper head, and a carrier, the process comprising:

receiving a threading end of a threading strip of a material web in the apparatus while the apparatus is located in an infeed position; and pivoting the gripper head, the infeed section, and the discharge section around the carrier on a swivel axis to locate the apparatus in a discharge position.

17. The process in accordance with claim 16, wherein, in the infeed position, the gripper head holds the material web during the pivoting.

18. The process in accordance with claim 16, wherein the threading end is guided through the apparatus and out of an opening prior to pivoting.

19. The process in accordance with claim 16, wherein the discharge section includes an accessory drive apparatus having at least one rotatable roll, and wherein said at least one rotatable roll is located above the threading strip in the infeed position and is located beneath the threading strip in the discharge position.

20. The process in accordance with claim 19, wherein, in the discharge position, the process further comprises forming a nip between the at least one rotatable roll and an upper roll forming a next nip through which the threading strip is to be guided.

21. The process in accordance with claim 20, wherein said accessory drive apparatus comprises an auxiliary roller which is arranged to frictionally drive said at least one rotatable roll.

22. The process in accordance with claim 21, wherein the auxiliary roller is driven by a lower roll forming the next nip through which the threading strip is to be guided.

23. The process in accordance with claim 16, wherein the apparatus further comprises a wall which is arranged to be positioned above the threading strip in the infeed position and to be positioned below the threading strip in the discharge position.

24. The process in accordance with claim 23, wherein the gripping head comprises a contact element, and the process further comprises pressing the contact element against the material web to pin the material web against the wall during pivoting.

25. A feed accessory apparatus for feeding the tail of a material web into a roll machine, comprising:

an infeed section;

a discharge section comprising an accessory drive apparatus having at least one rotatable roll and an auxiliary roller;

a gripper head comprising a holding mechanism;

a carrier;

said gripper head being pivotably arranged on said carrier to pivot around a swivel axis to be located in at least one of an infeed position and a discharge position, wherein, in said discharge position, said at least one rotatably mounted roller is positioned beneath the material web and said auxiliary roller is arranged beneath said at least one rotatably mounted roller, one of said at least one rotatably mounted roller and said auxiliary roller can be brought into driving contact with a roll of the roll machine;

said infeed section comprises a channel having at least a funnel-shaped cross sectional portion, and said channel opens downwardly in said infeed position; and said holding mechanism comprising a die that acts in conjunction with a mating surface.

* * * * *